United States Patent [19]

Humes

[11] Patent Number: 4,537,283

[45] Date of Patent: Aug. 27, 1985

[54] LADDER ASSEMBLY

[76] Inventor: Arnold F. Humes, R.R. #1, Ganges, British Columbia, V0S 1E0, Canada

[21] Appl. No.: 628,665

[22] Filed: Jul. 6, 1984

[51] Int. Cl.[3] ..... E06C 5/04

[52] U.S. Cl. ..... 182/127; 182/63; 182/194

[58] Field of Search ..... 182/127, 63, 194, 129, 182/93, 104, 2, 117

[56] References Cited

U.S. PATENT DOCUMENTS

| | | | |
|---|---|---|---|
| 882,161 | 3/1908 | Olive | 182/104 |
| 2,672,377 | 3/1954 | Werner | 182/2 |
| 2,794,558 | 6/1957 | Miles | 182/63 |
| 2,820,561 | 1/1958 | Meagher | 182/63 |
| 2,914,134 | 11/1959 | Weidner | 182/127 |
| 2,966,956 | 1/1961 | Campbell | 182/63 |
| 3,272,282 | 9/1966 | Sanders | 182/63 |
| 3,576,233 | 4/1971 | Thatcher | 182/63 |
| 4,113,055 | 9/1978 | Gleockler | 182/127 |

FOREIGN PATENT DOCUMENTS

| | | | |
|---|---|---|---|
| 2644651 | 6/1978 | Fed. Rep. of Germany | 182/127 |

*Primary Examiner*—Reinaldo P. Machado

[57] ABSTRACT

A ladder assembly for use on an articulating member of a moveable vehicle which includes a main ladder mountable on the member, a truss assembly coupled to the main ladder and couplable to the articulating member supporting the main ladder, and a bracing means affixed to the ladder assembly for bracing the main ladder from the ground.

8 Claims, 2 Drawing Figures

LADDER ASSEMBLY

FIELD

The present invention relates to a ladder assembly for use on an articulating member mounted on a movable vehicle.

BACKGROUND OF THE INVENTION

Conventional ladders are limited in their range of uses. Non self-supporting ladders are not practical for such applications as fruit tree picking due to the tree branches not being able to support a ladder with a person on it. Self-supporting ladders are generally moved from place to place and not extensible to provide access to varying levels. For example, in orchards it is frequently desirable to reach fruit at varying elevations without undue delay, in a way that does not necessitate resetting the ladder with each change in position and that does not require the ladder to extend up through the branches to reach the upper regions of the tree.

Traditionally, commercial tree picking operations use a hydraulically operated articulating arm supported on a movable vehicle and having a platform at the end of the arm for supporting a person. Such units are extremely expensive and often not within the financial means of most fruit farms.

SUMMARY OF THE INVENTION

According to the invention there is provided a ladder assembly for use on an articulating member of a movable vehicle, which includes a main ladder mountable on the member, a truss assembly coupled to the main ladder and couplable to the articulating member for supporting the main ladder and a bracing means affixed to the ladder assembly for bracing the main ladder from the ground.

Advantageously, the ladder may include a auxiliary ladder removably coupled to the bracing means for providing user access to the main ladder from the ground.

The truss assembly may include adjustable attaching means for removably affixing the ladder assembly to a bucket at an end of the articulating member.

The adjustable attaching means may include an elongated bar assembly, a pair of coupling members, each slidably coupled to a respective end of a bar assembly, bucket side engaging means affixed to a distal end of the coupling member, locking means for releasably locking the bucket, engaging means to respective sides of the bucket and hinge connection means coupled to a distal end of each of the coupling members for removable hinged connection of the bracing means to the coupling members.

The bracing means may include a brace guide removably coupled to each of the hinge connection means having a cylindrical bore, an elongated tube of circular cross section slidably received by the bore and a foot pad pivotally affixed to a foot of the tube and means for releasably locking the guide to prevent its downward sliding over the tube.

Preferably a coupling lock is located proximate each end of the tube for releasably locking attachment of the auxiliary ladder thereto.

The bucket side engaging means may include a depending plate affixed to an end of each of the bar assemblies transverse thereto, and a boss protruding from the plate towards an end of the bar opposite the distal end for sliding engagement with a corresponding receptacle in a corresponding side of the bucket.

Advantageously, the locking means may include a bolt threaded at one end, having a pawl wheel portion adjacent the threaded portion, a bar portion adjacent the pawl wheel portion of slightly larger diameter than the latter for slidable engagement with the bar assembly, and a cable engaging portion adjacent the plate portion having a cable aperture therethrough. A pawl wheel slidably engages the pawl wheel portion of the bolt and has a plurality of radially spaced apart teeth around its periphery. A cable has each of its ends affixed to a corresponding one of the opposed ends of the coupling member and passes through the cable aperture. A wrench having an elongated shaft and a threaded bolt receiving aperture, is provided for registration with the threaded portion of the bolt. A pawl arm removably engages with the teeth of the pawl wheel to maintain tensioning of the cable.

By mounting a ladder assembly on the implement located at the front end of an articulating member such as, for example, a bucket on the front of a front end loader, one can utilize a relatively inexpensive piece of equipment, namely a tractor, to provide a highly portable ladder capable of being raised and lowered to reach different heights. Moreover, by utilizing an adjustable attaching means, the assembly can be adapted to various sized buckets.

An auxiliary ladder permits the user to readily climb up and down from the bottom of the main ladder when the articulating member is raised to an operating position.

The locking means permits a rapid, simple attachment and removal from a bucket. By fabricating the ladder and truss of aluminum tubing, the entire assembly is easily handled by a single person.

The relatively simple structure of the ladder assembly makes it economical and affordable by even the most modest of operations.

BRIEF DESCRIPTION OF THE DRAWINGS

In drawings representing a preferred embodiment of the invention.

DETAILED DESCRIPTION WITH REFERENCE TO THE DRAWINGS

Figure 1:
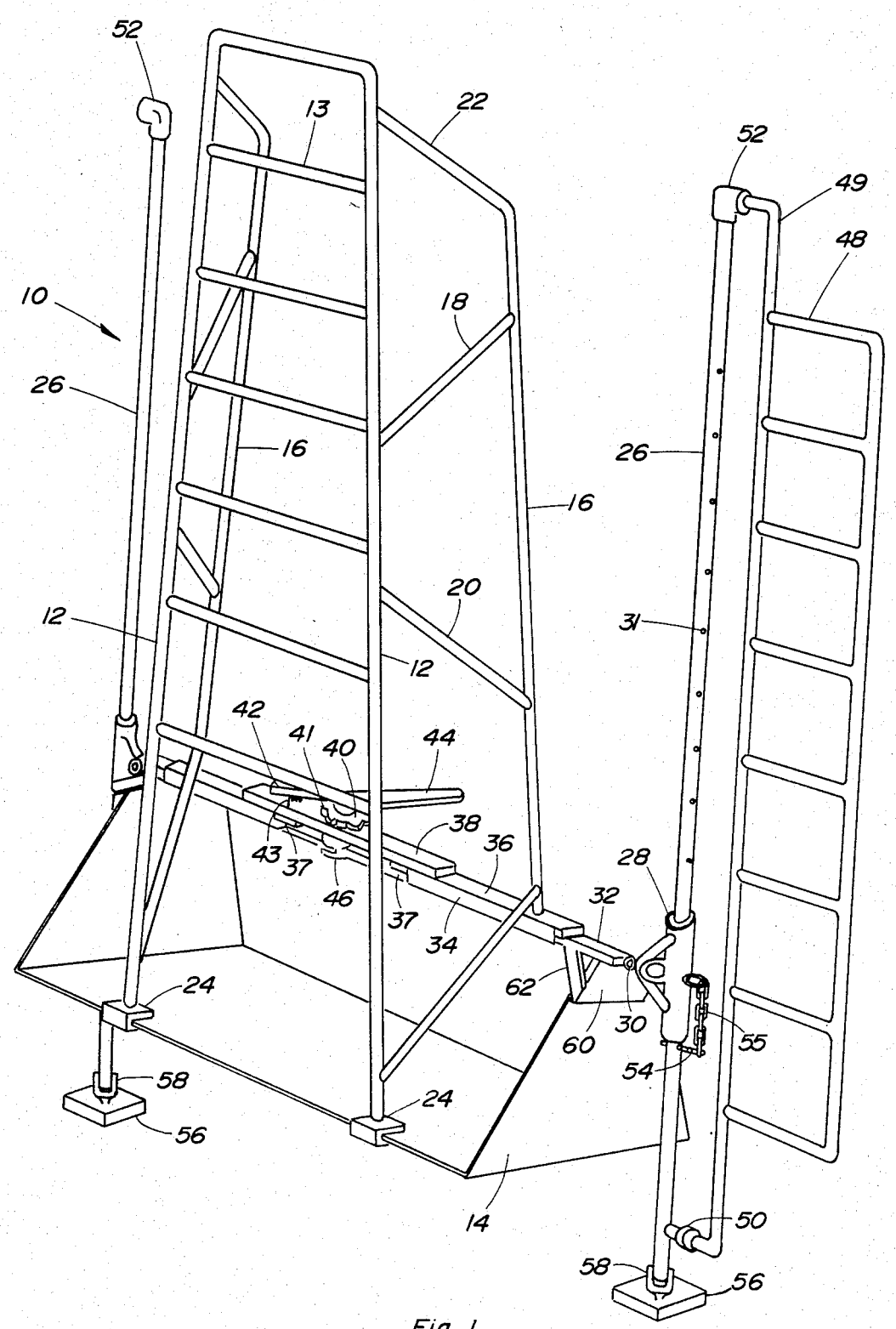
FIG. 1 is a perspective view of the ladder assembly mounted on the bucket which is normally affixed to the front of a front end loader or articulating member.
Figure 2:
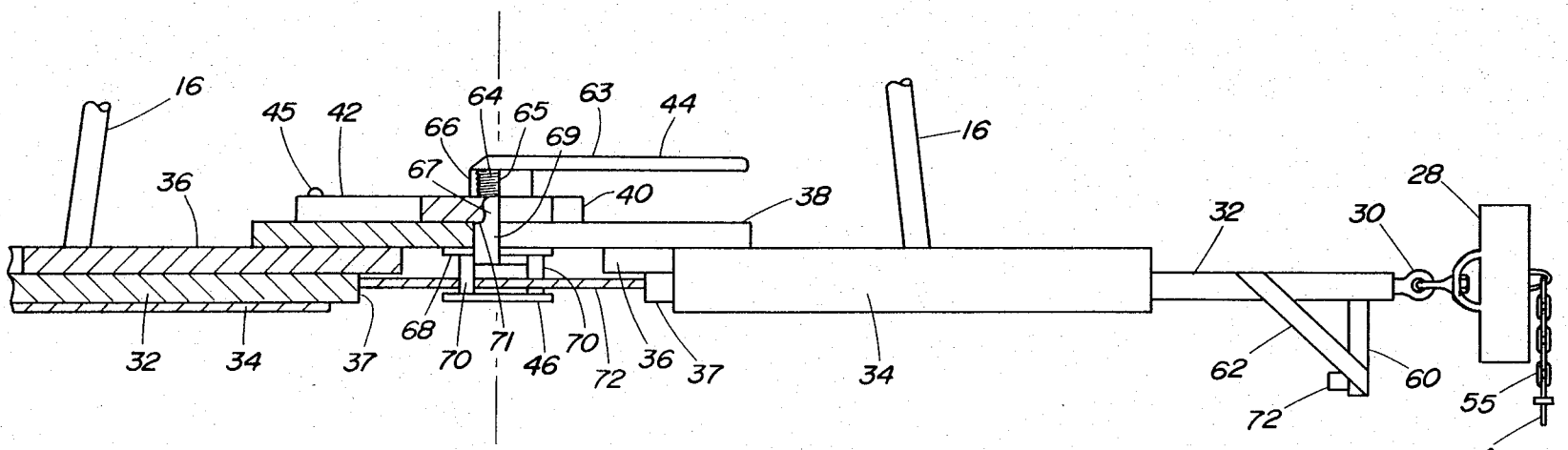
FIG. 2 is a partial sectional view in elevation showing the adjusting means for removably attaching the ladder assembly to the bucket.

As illustrated by FIG. 1, the ladder assembly 10 consists of a pair of side members 12 joined by transverse, spaced apart rungs and having a foot pad 24 at the bottom of each side member 12.

A bracing means is provided by a truss member 16 affixed by arms 18, 20 and 22 to each side member 12. To the bottom of the truss assemblies is attached on adjustable attaching means which includes an elongated bar assembly made up of central bar 38 and side bars 36 rigidly affixed to the underside of central bar 38 at either end thereof, leaving a gap on the underside of bar 38 between the two opposed end of side bars 36. Sections of angle iron 34 are affixed to the sides of side bars 36 to form a channel below the ladder which slidably receives respective coupling members 32. To the end of coupling members 32 there is affixed a transverse depending plate 60 braced by support bars 62, affixed to plate 32 and to plate 60 at an acute angle to each. To the inner side of plate 60 there is affixed to protruding boss 72 which is slidably insertable in a corresponding hole in the side of bucket 14 (not shown).

To the end of coupling member 32 is affixed a hinge connection means which provides a universal connection to a brace guide 28 which has a bore for slidably receiving an elongated tube 26 having a plurality of apertures 31 adapted to receive a pin 54 attached by a chain 55 to the brace guide 28. The bottom of the elongated tube 26 is attached by means of a universal coupling 58 to a foot pad 56. Releasable couplings 50 and 52 permit the attachment and removal of side tube 49 of auxiliary ladder 48.

To the top of central bar 38 is located a pawl wheel 40 having a plurality of radially spaced teeth 41 therearound and a pawl arm 42 pivotally attached by pin 45 and biased by coil spring 43 toward pawl wheel teeth 41. Pawl wheel 40 has a central aperture through which passes bolt 64 having a threaded end 65 protruding above the pawl wheel 40, a pawl wheel engaging unthreaded portion 67 and a bar portion adjacent the pawl wheel portion for slidable engagement with central bar 38. To the lower portion of bolt 64 there is affixed pair of discs 68 and 46 interconnected by spaced apart posts 70 to which are welded the bottom portion of bolt 64. Through the aperture formed between posts 70 there is passed a cable 72 affixed at either end to corresponding end 37 of coupling members 32.

A wrench 63 has a head 66 with a threaded aperture for registration with threaded end 65 of bolt 64 and an affixed shaft 44 for permitting user applied torque to be transmitted to head 66. A shoulder 71 is formed on bolt 64 at the boundary of the pawl wheel portion thereof and the bar portion.

In operation, the ladder assembly 10 is mounted on a bucket 14 by resting the side member foot pads 24 on the bottom of the bucket as shown in FIG. 1, pulling out coupling members 32 and placing the adjustment means atop the top end of the bucket 14. Next, wrench 63 is rotated to tighten the head 66 onto spindle wheel 40, forcing the latter to press against shoulder 71 and to lock to bolt 64. Further rotation of wrench 63 causes bolt 64 and pawl wheel 40 to rotate together and begin tensioning cable 72. The tensioning of cable 72 causes coupling members 32 to retract. Upon retraction, bosses 72 slidably enter into apertures (not shown) in the sides of the bucket 14. When fully tensioned, the pins 72 and side plates 60 are pressed firmly against the sides of the bucket 14. Pawl arm 42 abuts against one of teeth 41, preventing untensioning of cable 72. Next, one or both auxiliary ladders 48 are removably coupled to corresponding elongated tubes 26 and rotated to the desired position. The tubes 26 can be locked in an elevated position above the ground by insertion of pin 54 above brace guide 28. When the vehicle (not shown) having the articulating member (also not shown) which supports bucket 14, reaches a desired destination, elongated tubes 26 are lowered until foot pads 56 contact the ground. The elongated tubes 26 are then locked from sliding upwardly within brace guides 28 by insertion of pins 54 below the brace guide 28. Thus, any sideways motion of the main ladder is limited. The user may then climb up auxiliary ladder 48 to the bottom of the main ladder and then ascend the latter to the top.

In the event two persons are available, with one driving the self-propelled vehicle they simply lift the bucket 14, move the vehicle to a new location, lower bucket 14 without the person using the ladder having to descend and carry out the moving operation of the vehicle himself.

It will be obvious to those skilled in the art that the adjustment means may be adapted to any form of end implement used on an articulating arm other than a bucket. Clearly, the articulating arm may be rotatably mounted on the rear end of a truck or the like.

Other modifications, departures and variations lying within the spirit of the invention and scope as defined by the appended claims will be obvious to those skilled in the art.

I claim:

1. A ladder assembly for use on an articulating member of a moveable vehicle, comprising;

(a) a main ladder mountable on said member;

(b) a truss assembly coupled to said main ladder and couplable to said articulating member supporting said main ladder; and (c) bracing means affixed to said ladder assembly for bracing said main ladder from the ground.

2. A ladder assembly as defined by claim 1, including an auxiliary ladder removably coupled to said bracing means for providing user access to said main ladder from the ground.

3. A ladder assembly as defined by claim 2, wherein said truss assembly includes adjustable attaching means for removably affixing said ladder assembly to a bucket at an end of said articulating member.

4. A ladder assembly is defined by claim 3, wherein said adjustable attaching means includes an elongated bar assembly, a pair of coupling members each slidably coupled to a respective end of said bar assembly, bucket side engaging means affixed to a distal end of said coupling members, locking means for releasably locking said bucket engaging means to respective sides of said bucket and hinge connection means coupled to a distal end of each of said coupling members for removable hinged connection of said bracing means to said coupling members.

5. A ladder assembly as defined by claim 3, wherein said bracing means includes a brace guide removably coupled to each of said hinge connection means having a cylindrical bore, an elongated tube of circular cross section slidably received by said bore and a foot pad pivotally affixed to a foot of said tube and means for releasably locking said guide to prevent its downward sliding over said tube.

6. A ladder assembly as defined by claim 5, including a coupling lock proximate each end of said tube for releasable locking attachment of said auxiliary ladder thereto.

7. A ladder assembly as defined by claim 4, wherein said bucket side engaging means includes a depending plate affixed to an end of each of said bar assemblies transverse thereto and a boss protruding from said plate towards an end of said bar opposite said plate, the distal end for sliding engagement with a corresponding receptacle in a corresponding side of said bucket.

8. A ladder assembly as defined by claim 7, wherein said locking means includes (d) a bolt threaded at one end and having a pawl wheel portion adjacent the threaded portion, a bar section adjacent said pawl wheel portion of slightly larger diameter than the latter for slidable engagement with said bar assembly and a cable engaging portion adjacent said plate portion having a cable aperture therethrough;

(e) a pawl wheel slidably engaging the pawl wheel portion of said bolt having a plurality of radially spaced apart teeth around its periphery;

(f) a cable each end of which is affixed to one of the opposed ends of said coupling members and passing through said cable aperture;

(g) a wrench having an elongated shaft and a threaded bolt receiving aperture at one end for registration with the threaded portion of the bolt; and (h) a pawl arm removably engagable with the teeth of said pawl wheel to maintain tensioning of said cable.

* * * * *